United States Patent [19]

Mickelsen

[11] Patent Number: 4,860,502

[45] Date of Patent: Aug. 29, 1989

[54] DECK GUTTER SYSTEM

[76] Inventor: Michael M. Mickelsen, N. 13818 Karen La., Spokane, Wash. 99208

[21] Appl. No.: 127,635

[22] Filed: Dec. 2, 1987

[51] Int. Cl.[4] ..... E04D 13/00

[52] U.S. Cl. ..... 52/11; 52/127.5; 52/462; 52/478

[58] Field of Search ..... 51/11, 13, 14, 15, 462, 51/478, 127.5

[56] References Cited

U.S. PATENT DOCUMENTS

| | | | |
|---|---|---|---|
| 313,652 | 3/1985 | Cortright | 52/13 |
| 409,387 | 8/1889 | Brown et al. | 52/13 |
| 872,018 | 11/1907 | Repp | 52/462 |
| 3,066,771 | 12/1962 | Wolchuk | 52/478 |
| 3,245,187 | 4/1966 | May | 52/478 |
| 3,286,404 | 11/1966 | Harrison . | |
| 3,388,515 | 6/1968 | Gruettner | 52/478 |
| 4,065,883 | 1/1978 | Thibodeau . | |
| 4,091,588 | 5/1978 | Heirich | 52/478 |
| 4,244,355 | 1/1981 | Stout | 52/11 |
| 4,257,716 | 3/1981 | Woodrow | 52/11 |
| 4,411,109 | 10/1983 | Struben et al. . | |
| 4,663,894 | 5/1987 | LaRoche et al. | 52/15 |

FOREIGN PATENT DOCUMENTS

| | | | |
|---|---|---|---|
| 3422126 | 12/1985 | Fed. Rep. of Germany | 52/11 |

*Primary Examiner*—David A. Scherbel
*Assistant Examiner*—Caroline D. Dennison
*Attorney, Agent, or Firm*—Wells, St. John & Roberts

[57] ABSTRACT

A deck gutter is illustrated for mounting beneath the surface decking of a wooden deck between adjacent wooden joists. The deck gutter includes "J" shaped hangers that are mounted along an incline with respect to facing adjacent joist surfaces. A uniform cross-section gutter panel 56 is mounted between the hangers for receiving rain water through the cracks or spacing between adjacent decking boards for conveying the water away from and protecting the space below the deck surface. The gutter panel 56 has a central portion 58 with side wall portions 60, 62 extending upward to flanges. Each of the side wall portions has a "Z" shaped expansion band for accommodating during spacing between the joists and any bowing that may occur along the length of the joists.

9 Claims, 3 Drawing Sheets

FIG. II

FIG 5A
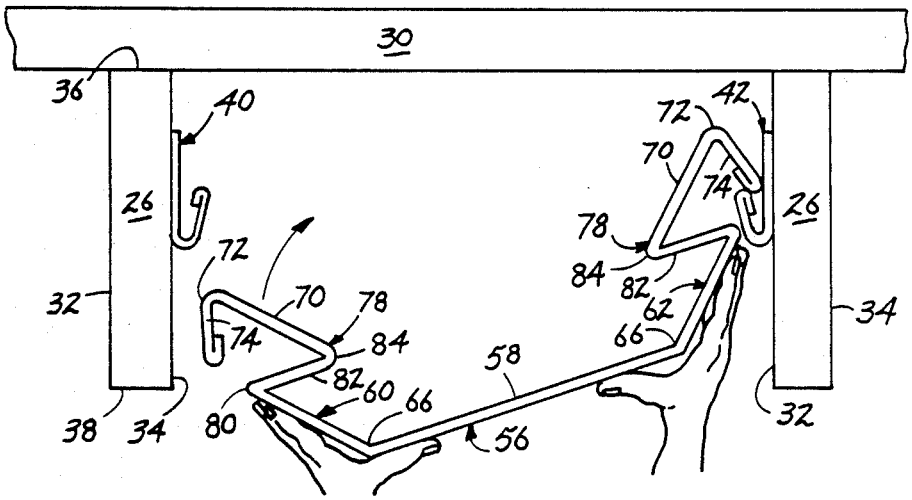
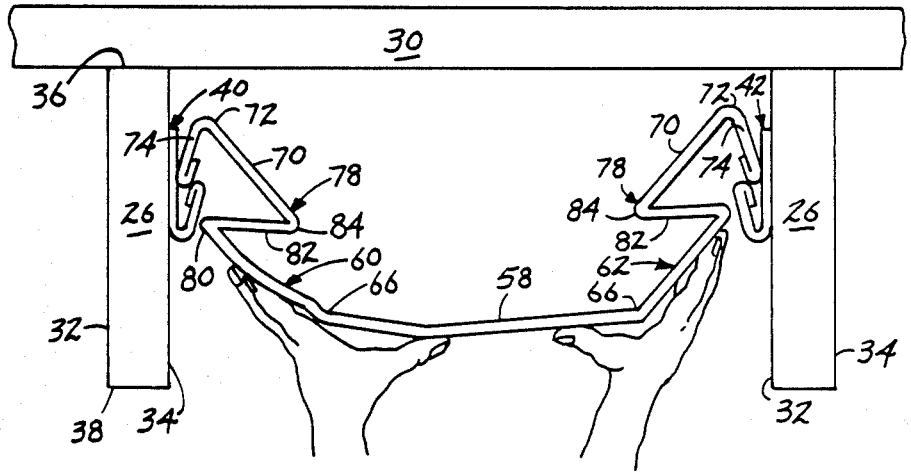
FIG 5B
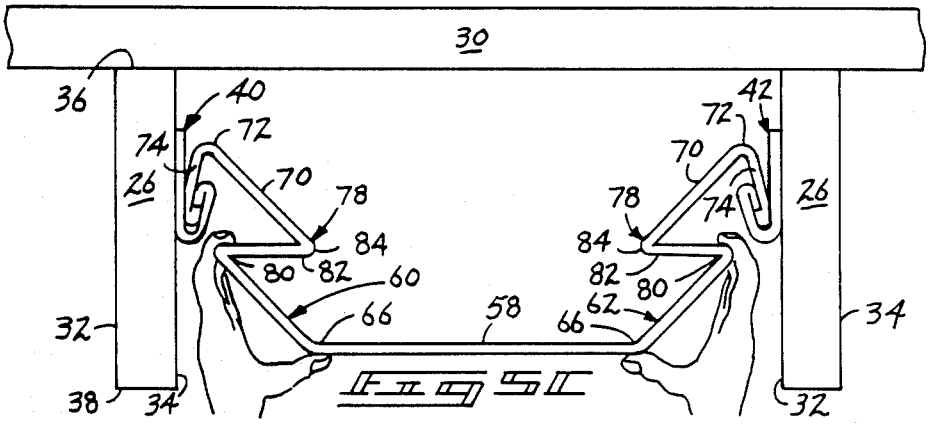
FIG 5C

DECK GUTTER SYSTEM

TECHNICAL FIELD

This invention relates to deck gutters.

BACKGROUND OF THE INVENTION

Many building structures have wooden decks attached thereto in which the wooden deck surface is supported by wooden deck joists. The deck surfacing generally consists of 2×4's or 2×6's that are laid on their sides with the deck members being spaced from each other to enable rain and spray water to dissipate between the members through the "deck cracks." Often it is desirable to catch the rain and water and conduct the water away from the building structure and from beneath the deck.

A deck gutter system as illustrated in U.S. Pat. No. 4,065,883 in which the deck system includes a panel having channels formed therein that fit over and between the wooden joists. However, the panel must be mounted while the deck is being constructed before the upper surface is in place. Furthermore, such a panel is very expensive to manufacture as it requires a specialized male and female forming dye in which the base is tapered downwardly from one end to the other to facilitate the flow of water. Other types of gutter systems are illustrated in U.S. Pat. No. 3,286,404 and 4,411,109.

One of the objectives of this invention is to provide a unique deck gutter system that can be mounted to an alreay existing deck to convey the water from beneath the decking surface away from the building structure.

A further object of this invention is to provide a unique deck gutter system that can be easily constructed and manufactured to provide a deck gutter system within the financial capability of the ordinary home owner.

These and other objects of this invention become apparent upon reading the following detailed description of a preferred embodiment.

BRIEF DESCRIPTION OF THE DRAWINGS

A preferred embodiment of this invention is illustrated in the accompanying drawings, in which:

FIGS. 5A, 5B, 5C are a sequence of illustrated end views of the gutter system illustrated in FIG. 1 in which FIG. 5A shows a deck gutter initially positioned between two deck joists; FIG. 5B illustrates the bending of the deck gutter to move deck gutter above gutter hangers; and FIG. 5C illustrates the deck gutter being moved downward with flanges of the deck gutter fitting snugly in the gutter hangers.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
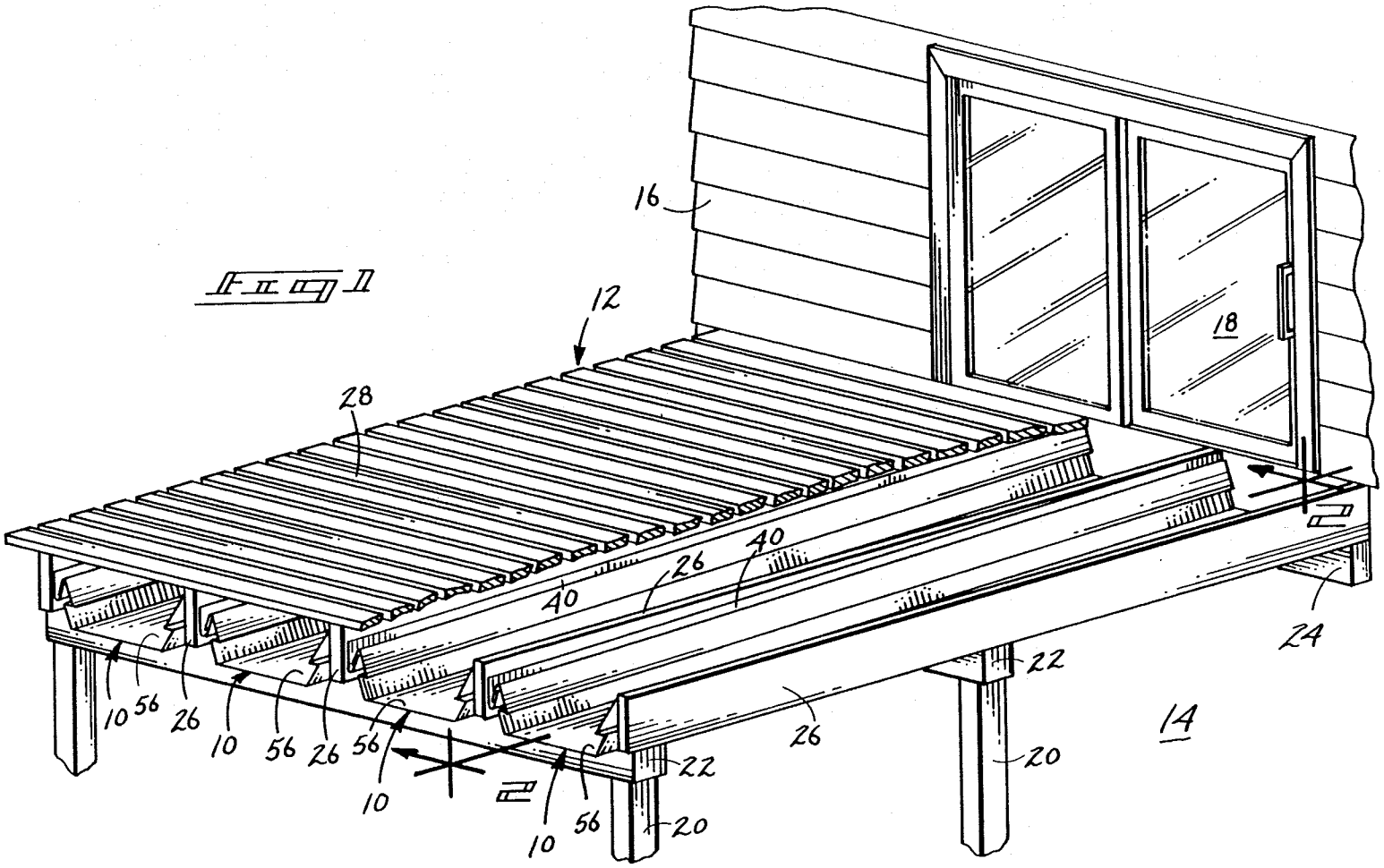
FIG. 1 is a perspective view of a wooden deck with a deck gutter system illustrated.

Referring in detail to the drawings, there is illustraed in FIG. 1 a plurality of deck gutters 10 that are mounted to wood deck 12 for conveying rain or washwater from an underneath area 14. The deck 12 is usually attached to a building 16. In many cases the building 16 has a sliding glass door 18 in one wall for enabling inhabitants of the building to move from the building onto the wooden deck 12.

Figure 2:
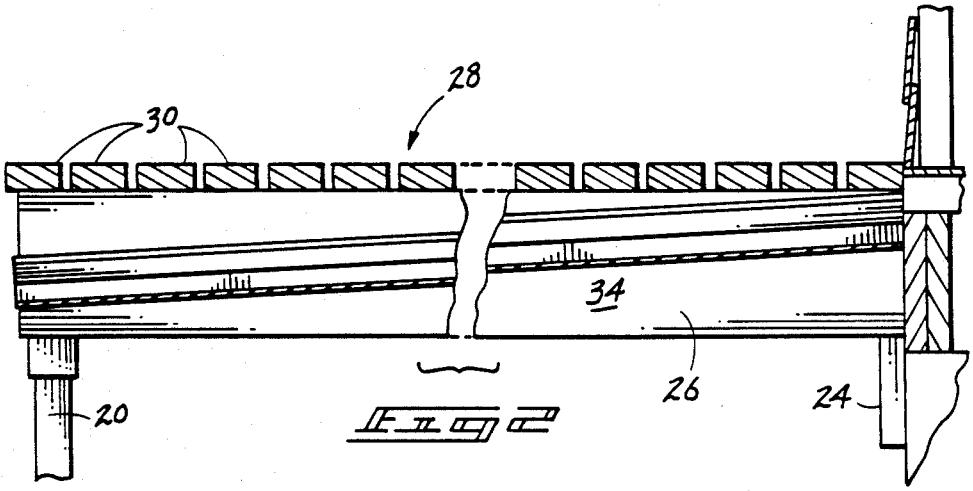
FIG. 2 is a vertical cross-sectional view taken along line 2—2 in FIG. 1.

The wooden deck 12 is constructd using vertical posts 20 that are utilized for supportng cross beams 22. Generally a cross anchor 24 is attached to the building 16 parallel with the beams 22. The wooden deck 12 includes wooden deck joists 26 that extend substantially parallel with each other supported by the beams 22 and the anchor 24 as illustrated in FIG. 2. Each of the deck joists 26 are generally 2×6's or 2×8's mounted on edge on the beams 22 for supporting a surface decking material 28. The surface decking materal 28 includes decking boards 30 that are generally 2×4's or 2×6's that are laid on their side surfaces. The decking boards 30 are spaced from each other, providing spaces or cracks, to permit rain water or washwater to drain from the upper surface and pass through the openings or cracks to a level below.

Figure 3:
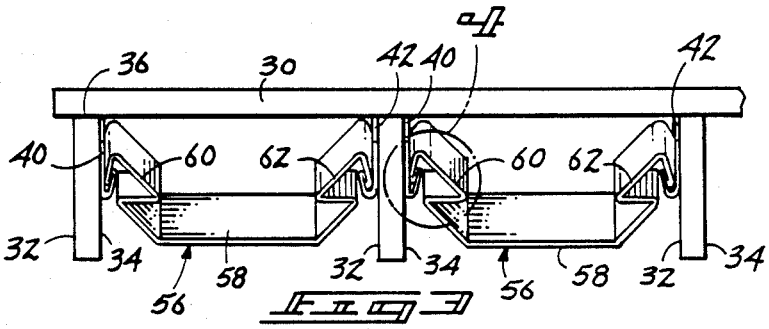
FIG. 3 is a transverse cross-sectional view taken along line 3—3 in FIG. 2.

Each of the deck joists 26 (FIGS. 3–5) includes vertical side surfaces 32 and 34 that are oriented in upright direction terminating at a top surface 36 and a bottom surface 38. The bottom surface 38 engages the beams 22 and the top surface 36 receives the decking boards 30.

Each of the deck gutters 10 includes a gutter hanger 40 and a gutter hanger 42. Preferably the gutter hangers 40 and 42 are mirror images of each other. Each of the hangers 40, 42 (FIG. 4) include a back section 44 that engages a respective joist side surface 32, 34. Generally nails or screws 46 are driven through the back section 44 to affix the hanger 40, 42 to the side surface 32, 34 of a respective joists 26. Each of the hangers 40, 42 includes a lower bend section 48 that has a bend radius substantially greater than 90° forming an upward projecting hook section 50. The hook section 50 terminates in a folded edge 52 in which the edge is folded back upon iteslf. The hook section 50 in conjunction with the back section 44 forms a longitudinal rceiving channel therebetween.

As illustrated in FIGS. 1 and 2, the gutter hangers 40, 42 are mounted to the surfaces 32, 34 at an incline angle with respect to the deck joist 26. Preferably the hangers 40, 42 are of uniform cross section along their entire length. Preferably the hangers 40, 42 extend along a major portion of the length of the deck joist 26.

The deck gutter 10 includes a elongated gutter panel 56 that preferably has a uniform cross section along its entire length for mounting beneath the surface decking 28 supported by the gutter hangers 40 and 42 between adjacent deck joists 26. The gutter panel 56 (FIGS. 3–5) includes a central portion 58 and side wall portions 60 and 62 that extend upward from the central portion to the gutter hangers 40 and 42 respectively.

Each of the side wall portions 60, 62 have an upward bend 66 (FIG. 4) from the central portion 58. Each of the side wall portions 60, 62 includes a lower wall section 68 that extends upward at an inclined outward angle from the upward bend 66. Each of the side wall portions 60, 62 includes an upper wall section 70 that extends upward to a downward bend 72 that is normaly positioned above the receiving channel of the gutter hangers 40, 42. Downward bend 72 terminates in a downward projecting flange 74 that extend into the receiving channel of the hangers 40, 42.

Intermediate the lower wall section 68 and the upper wall section 70 is an expansion section 78 that is preferably Z-shaped for enabling the gutter panel 56 to be adjusted laterally to accommodate different spacings between adjacent joists 26 and to additionally accommodate any bow in the joist that cause a varying spacing between adjacent joist along the length of the joist. Furthermore the longitudinal expansion section 78 provides means for enabling an installer to grip the gutter panel 56 and to insert the gutter as illustrated in FIG. 5A–C and to pull the gutter panel 56 downward with sufficient force to wedge the flanges 74 into the hangar receiving channels.

The expansion section 78 includes an inward bend 80 from the lower wall section 68 to an intermediate section 82 that extends inward from the inward bend 80 to an outward bend 84. The inward bend 80 and the outward bend both have bending radii of more than 90°.

Figure 4:
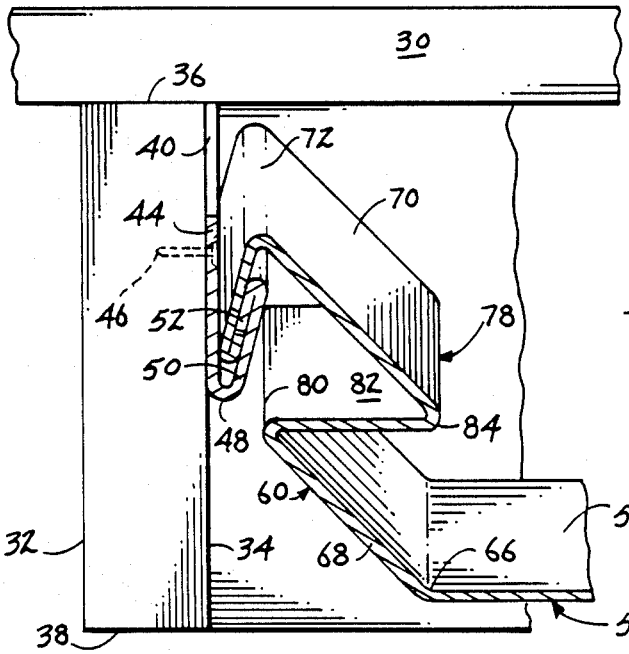
FIG. 4 is an enlarged view taken from FIG. 3 as illustrated by the enclosed section identified along circle 4.

The flange 74 extends downward and terminates in a lip that is turned inward upon itself to form a smooth edge and to form a curled overlapping finger grip with the hook section 50 as illustrated in FIG. 4.

To install the deck gutter 10, the installer initially mounts the gutter hanger 40 to the vertical side surface 32 of one deck joist 26 and the other gutter hanger 42 to the vertical side surface 34 of the adjacent deck joist 26. The gutter hangers 40, 42 are mounted at an incline angle as illustrated in FIG. 2 before receiving the gutter panel 56. The gutter panel 56 as illustrated in FIG. 5A is initially placed beneath the deck joists 26 and then bent as illustrated in FIG. 5B so that the width of the gutter panel 56 is less than the spacing between the joists 26 so that the panel 56 may be inserted between the joists vertically above the hangers 40, 42 as illustrated in FIG. 5B.

Then the installer engages the inward bend 80 and the intermediate section 82 as illustrated in FIG. 5C and pulls the gutter panel 56 downward with the flanges 74 projecting into the receiving channels 54 of the hangers 40, 42. The flanges 74 interconnect with the folded edge 52 in an overlapping, gripping relationship so that the gutter panels 56 will not vibrate loose from the hangers 40, 42.

It should be noted that the Z-shaped expansion section 78 automatically adjusts for differences between adjacent joists 26 and additionally accommodates for any bowing that occurs in the length of the joists. Furthermore, it should be noted that the gutter panel is uniform in cross-section in its length and may be easily extruded to provide a relatively inexpensive deck gutter 10 with rather complicated cross-sectional design.

In compliance with the statute, the invention has been described in language more or less specific as to structural features. It is to be understood, however, that the invention is not limied to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A deck gutter for mounting between two adjacent wooden deck joists of a wooden deck for receiving and directing water that passes through a wooden deck material away from any area below the wooden deck, comprising:

an elongated sheet metal body having an elongated central portion and a first side wall portion extending upward from the central portion terminating in a first flange for attaching to a side surface of one joist and a second side portion extending upward from the central portion terminating in a second flange for attaching to a side surface of the adjacent joist;

at least one of the side wall sections having a longitudinal expansion bend formed therein to enable the deck gutter to expand or contract transversely to accommodate spacing variations between adjacent joists and to accommodate bows in either of the adjacent joists; and at least one of the side wall sections has an inward bend acting as a gripping means intermediate the central portion and the flange for enabling an installer to grip and install the deck gutter from beneath the joist by pulling downward to attach the flanges.

2. The deck gutter as defined in claim 1 wherein the deck gutter has a uniform cross-sectional area along its length.

3. The deck gutter as defined in claim 1 wherein the one side wall portion includes a double bend in which the side wall portion has the inward bend that is directed inward toward the other side wall portion and an outward bend that is directed outward from the other side wall portion.

4. The deck gutter as defined in claim 3 wherein the double longitudinal bend is "Z-shaped."

5. The deck gutter as defined in claim 1 wherein each of the terminal flanges is reversed upon its respective side wall portion and extends downward and outward.

6. The deck gutter as defined in claim 1 wherein the longitudinal sheet metal body defines a gutter channel and wherein the deck gutter further comprises a first hanger mounted to a side surface of one joist for supporting the gutter channel along the first side wall portion and a second hanger mounted to a side surface of the adjacent joist for supporting the gutter channel along the second side wall portion.

7. The deck gutter as defined in claim 6 wherein each of the hangers has a elongated sheet metal hanger body with a receiving channel formed therein to receive a flange of one of the side wall portions.

8. The deck gutter as defined in claim 7 wherein each of the hangers is "J" shaped having a back section for engaging the side surface of the joist and an elongated folded hook section forming the channel between the hook section and the back section to receive the flange.

9. The deck gutter as defined in claim 1 wherein the gripping means is formed integrally with the longitudinal expansion bend.

* * * * *

UNITED STATES PATENT AND TRADEMARK OFFICE

CERTIFICATE OF CORRECTION

PATENT NO. : 4,860,502

DATED : August 29, 1989

INVENTOR(S) : Michael M. Mickelsen, et al.

It is certified that error appears in the above-identified patent and that said Letters Patent is hereby corrected as shown below:

Title page, item [76] should read:

INVENTORS: Michael M. Mickelsen
N. 13818 Karen Lane
Spokane, Washington 99208

Wayne F. Palm
E. 523 Maxine
Spokane, Washington 99218

Signed and Sealed this

Sixteenth Day of October, 1990

*Attest:*

HARRY F. MANBECK, JR.

*Attesting Officer*

*Commissioner of Patents and Trademarks*